US005184561A

United States Patent [19]

Nickell, Jr.

[11] Patent Number: 5,184,561

[45] Date of Patent: Feb. 9, 1993

[54] PLANING PONTOON BOAT

[76] Inventor: William F. Nickell, Jr., Beachcomber Boats, Inc. Rte. 1, Box 18045, Porum, Okla. 74455

[21] Appl. No.: 738,258

[22] Filed: Jul. 30, 1991

[51] Int. Cl.[5] ..... B63B 35/44

[52] U.S. Cl. ..... 114/61; 114/283; 114/292

[58] Field of Search ..... 114/61, 283, 292, 274, 114/288

[56] References Cited

U.S. PATENT DOCUMENTS

| | | | |
|---|---|---|---|
| 1,782,868 | 11/1930 | Deetjen | 114/292 |
| 2,375,973 | 5/1945 | Cooper et al. | 114/292 |
| 2,996,030 | 8/1961 | Lornson | 114/283 |
| 3,221,697 | 12/1965 | Allegretti | 114/274 |
| 3,357,390 | 12/1967 | Wray | 114/274 |
| 3,625,173 | 12/1971 | Mitton | 114/61 |
| 3,768,429 | 10/1973 | Greer | 114/274 |
| 4,356,787 | 11/1982 | Harley et al. | 114/292 |

FOREIGN PATENT DOCUMENTS

| | | | |
|---|---|---|---|
| 498486 | 1/1920 | France | 114/292 |
| 1466218 | 1/1967 | France | 114/292 |

*Primary Examiner*—Joseph F. Peters, Jr.
*Assistant Examiner*—Stephen P. Avila
*Attorney, Agent, or Firm*—Paul W. Hemminger

[57] ABSTRACT

A pontoon boat comprising elongated flotation units of generally circular cross-section positioned in spaced-apart parallel relationship with each of the flotation units having planing fins extending longitudinally of the inboard and outboard sides of the flotation units near the bottom thereof to cause the pontoon boat to readily hydroplane. A wedge-shaped fin is provided on the underside of the outboard planing fins near the bow section to provide additional lift when turning at high speeds to improve control and stability on turns.

6 Claims, 3 Drawing Sheets

PLANING PONTOON BOAT

BACKGROUND

1. Field of the Invention

The present invention relates in general to catamaran boats and in particular to pontoon boats wherein the flotation units consist of two elongated water-tight elements of circular cross-section. A pair of external planing fins positioned along the sides of each flotation unit cause the pontoon boat to plane and auxiliary wedge-shaped elements secured to the outboard planing fins provide improved stability while turning the pontoon boat at planing speeds.

2. The Prior Art

A catamaran or pontoon boat normally comprises two separate flotation units bridged by an elevated deck surface which maintains the flotation units in a parallel relationship and spaced a substantial distance apart to provide a vessel having exceptional stability in rough water as a result of its large beam/length ratio. Prior-art pontoon boat flotation units are known which are of a U-shape, circular, octagonal or rectangular cross-sectional configuration. However, the flotation units of most pontoon boats are of a circular cross-section as such flotation units have a low fabrication cost and possess substantial strength without the need for reinforcing structural elements.

Pontoon boats with cylindrical flotation units of U-shaped or circular cross-section have poor planing capabilities as the curvature of the flotation unit area contacting the surface of the water provides extremely small lift throughout a wide range of speeds. If pontoon boats with circular flotation units are propelled at high speeds by use of more powerful motors, the small surface contacting the water cannot maintain the pontoon boat at a constant level and the bow repeatedly rises and falls creating a dangerous control situation.

Another disadvantage of pontoon boats is that the center of gravity of such boats is above the water line and on turns, centrifugal force causes the vessel to bank outwardly. This outward banking increases the downward force on the outboard flotation unit which is furthest from the center of the turn and such flotation unit sinks deeper in the water than normal during a straight course. When turning at higher speeds, greater centrifugal force results and the outboard flotation unit tends to become completely submerged, thereby creating additional drag which generates control problems as well as substantially increasing the turning radius of the vessel.

SUMMARY OF THE INVENTION

The present invention resides in a pontoon boat having cylindrical flotation units of circular cross-section, with planing fins secured to the outside of each flotation unit near the bottom thereof. At low speed, the planing fins are below the water line, generate inconsequential drag and are ineffective to create sufficient lift to start a planing action. At higher speeds, the bow lifts slightly, moving the forward section of the planing fins above the water line. The fins present a larger area to the surface of the water, causing the pontoon boat to start planing. As the speed is further increased, the bow of the boat moves higher and the point at which the water line contacts the planing fins moves toward the stern causing the boat to assume a planing position. Since the planing fins increase the area contacting the surface of the water, the bow does not repeatedly rise and fall as in prior-art vessels and control is not hampered. Since the inventive pontoon boat planes without the noted control problems, drag is greatly reduced, resulting in speed increases up to 15–20 miles per hour over similar pontoon boats without the inventive planing fins.

The present invention overcomes the noted instability of prior-art pontoon boats while turning at high speeds, as specially formed turning wedges are secured to the underside of the outboard planing fin of each flotation unit near the forward end of their respective fins. The inventive turning wedges complement the lifting function of the planing fins as well as improve stability in turns.

In the straight-line planing mode, as the pontoon boat accelerates from rest, the bow lifts and the planing fins with the aid of the turning wedges on the underside starts the pontoon boat to plane. As acceleration continues, the point at which the water line contacts the planing fins moves toward the stern and the forward section of the planing fins and attached turning wedges lift completely out of the water and high speed planing occurs with no drag from the turning wedges. When deceleration starts, the point at which the water contacts the planing fins moves toward the bow, ultimately lowering the turning wedges and forward planing fin surfaces into the water.

In the turning mode at high planing speeds, centrifugal force causes the pontoon boat to bank outwardly, resulting in the outboard flotation unit moving deeper into the water. As the forward portion of the planing fins of the outboard flotation unit approach the water surface, the turning wedge on the outboard flotation unit contacts the surface of the water and as a result of its special configuration, imparts a strong lifting force countering the noted centrifugal force. This lifting force prevents the planing fins on the outboard flotation unit from becoming completely submerged with little or no lift as would occur in pontoon boats travelling at similar speeds without the inventive turning wedges. When the turn is completed, centrifugal force ceases and the forward end of the planing fins and turning wedge on the outboard flotation unit both lift out of the water as described in the straight-line planing mode.

BRIEF DESCRIPTION OF THE DRAWINGS

The present invention will be better understood from the following detailed description of a preferred embodiment of the invention when considered in connection with the accompanying drawings in which.

DESCRIPTION OF THE PREFERRED EMBODIMENTS

Figure 1:
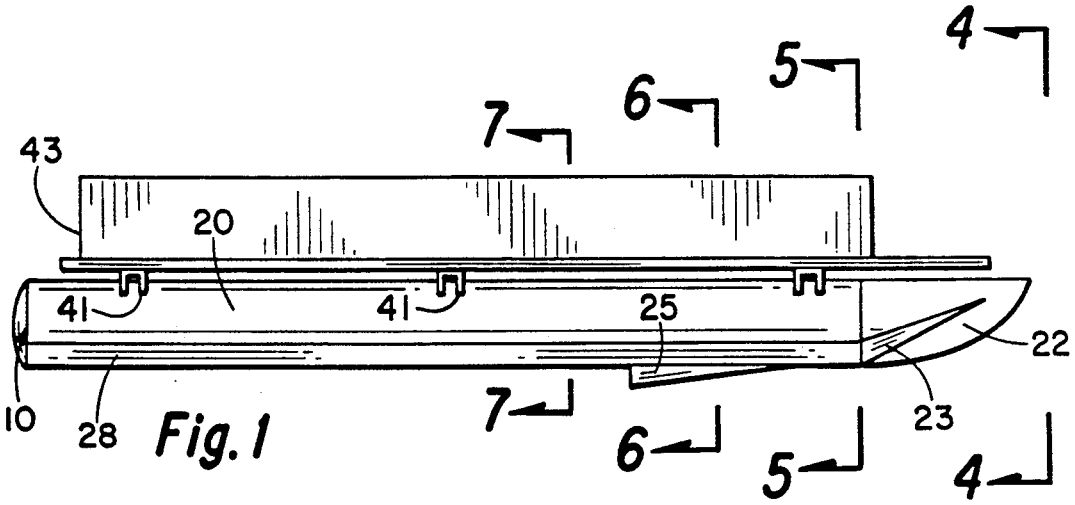
FIG. 1 is a side elevational view of the preferred embodiment of the inventive planing pontoon boat.

Referring to the drawings, the preferred embodiment of the invention shown in FIGS. 1 through 14 will now be described. In these drawings, like reference numerals will represent corresponding parts.

Figure 2:
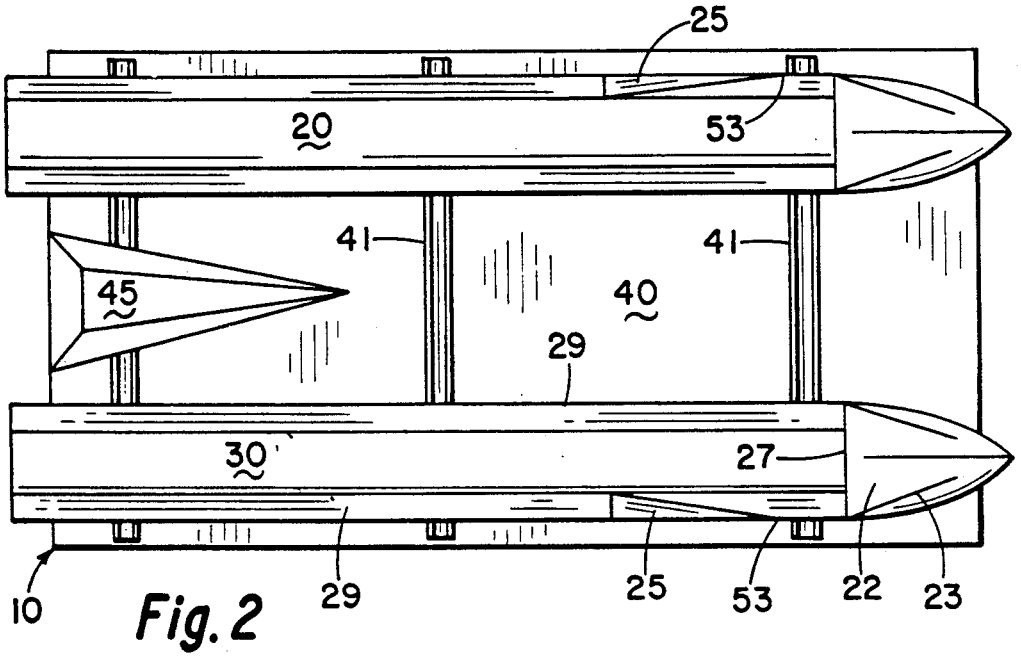
FIG. 2 is a bottom elevational view of the preferred embodiment of the inventive planing pontoon boat.
Figure 3:
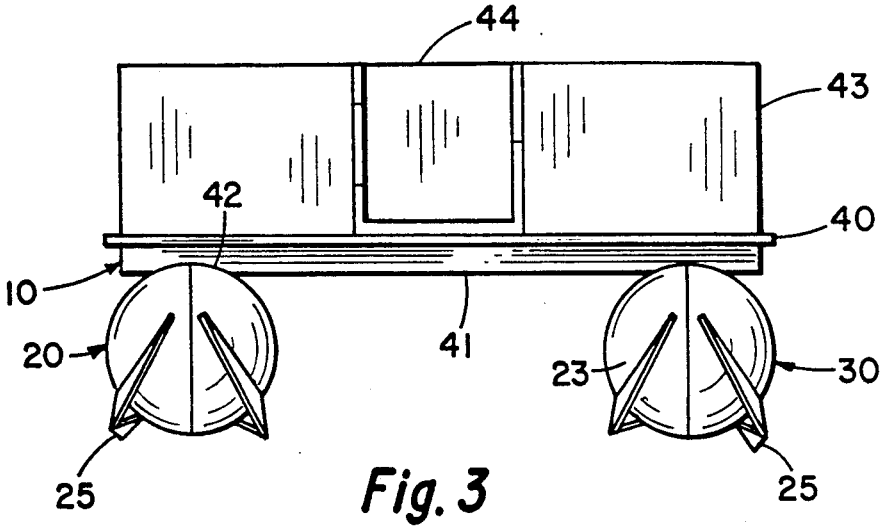
FIG. 3 is an enlarged front elevational view of the pontoon boat shown in FIGS. 1 and 2.

The pontoon boat 10, best seen in FIGS. 1 through 3, comprises a starboard flotation unit 20 and a port flotation unit 30 secured in spaced-apart parallel relationship by U-shaped cross members 41 secured, as by welding, to the two flotation units at seams 42. These members 41 are also secured to deck 40 by any suitable attaching means. The perimeter of deck 40 is enclosed by guard rails 43 with access to such enclosure through gate 44. An outboard motor, not shown, is normally mounted on transom 45.

The flotation units 20 and 30 are each shown as a single water-tight elongated cylinder, but each may comprise two or three sections secured together, as by welding, with a nose cone or flotation unit bow 22 secured to the forward end of each flotation unit. The nose cones 22 are of circular cross-section at the point they are attached to the forward end of the flotation unit and are smoothly tapered to a V-shaped prow. Splash trap or splash guard elements 23 are secured to both sides of each nose cone to prevent splash or spray from being projected onto the deck.

The foregoing description of the major components of a pontoon boat is that of conventional prior-art pontoon boats and further details of these major components are not deemed necessary.

Referring to FIGS. 1 through 7, a detailed description of the structure of the planing fins 24 will be given.

Both of the flotation units 20 and 30 have two V-shaped planing fins 24 secured thereto each consisting of an upper section 28 and a lower section 29 which may be formed from lengths of flat metal bent along their central longitudinal axis to form identical fin sections, preferably disposed at an angle of sixty degrees to each other. As seen in FIGS. 1 and 2, the planing fins are each of a length such that they extend from the stern end of the flotation units to the junctions 27 where the nose cones 22 are secured to the bow ends of the flotation units.

In the preferred embodiment, the planing fin sections 28 and 29 are of a selected width such that when secured to the flotation units as shown in FIGS. 4 through 7, the fold line between the upper and lower sections of each planing fin lies along the intersection of a horizontal plane tangent to the bottom of the flotation unit and a vertical plane tangent to the side of the flotation unit. The planing fins 24 are secured, as by welding, to their respective flotation units in the above described position. The tunnel or cavity 26, created when each fin is secured to its flotation unit, extends the full length of the flotation units with both ends of the cavities 26 being open to permit water to readily pass therethrough. The lower sections 29 of the two planing fins 24 on each flotation unit, together with flotation unit surface 46 located therebetween, define a modified flotation unit effectively consisting of two interconnected sub-flotation units spanning a width equal to the diameter of their respective flotation units.

When the nose cone or bow of a pontoon boat cuts through the water, splash is generated which moves upwardly and rearwardly toward the deck surface as the boat progresses. This splash is commonly deflected downwardly by splash traps or splash guards on each side of each nose cone. The splash guards normally consist of short lengths of flat strips of metal having one edge thereof secured to the side of the nose cone and extending horizontally or in a downward direction from the forward section thereof to the junction of the nose cone with the flotation unit.

Figure 4:
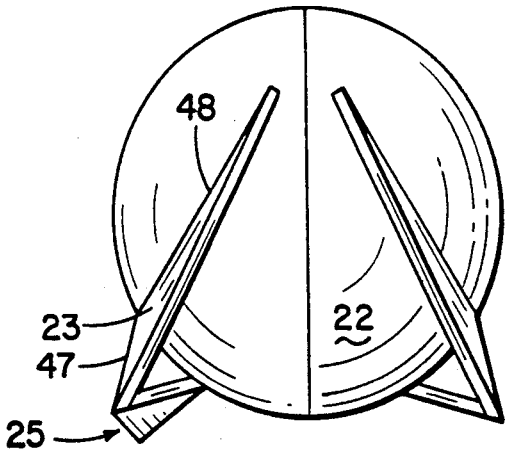
FIG. 4 is an enlarged front elevation view of the starboard flotation unit of the pontoon boat taken along lines 4—4 of FIG. 1.

As best seen in FIGS. 1, 3 and 4, flat triangular-shaped splash traps 23 are provided which have their base portion 47 rigidly secured to the forward end of the upper section 28 of planing fin 24 of each flotation unit and which have their side 48 angling upwardly toward the forward portion of nose cones 22 and rigidly secured thereto. Water splash that moves upwardly and rearwardly from the bow is collected in the cavity between the nose cone and the undersurface of splash guard 23 where it is directed in and through cavity 26 and released at the stern of the boat.

As before described, each of the flotation units 20 and 30 has a pair of planing fins 24 secured thereto and as best seen in FIGS. 1 and 2, the outboard planing fin of each flotation unit has a turning wedge 25 secured to its lower section 29 near its bow end. As seen in the FIG. 8 perspective view, each turning wedge 25 has two sides 51 and 52, each of a right-triangular configuration and having a common base. The sides 51 and 52 are angularly displaced from each other about their common base, preferably at a 90-degree angle, with the hypotenuse of each triangulally shaped side 51 and 52 meeting at a common point 53. The height or altitude of side 51 is preferably one-half the altitude of side 52 whose altitude is selected such that the distance from the spaced-apart vertices of each side is equal to the width of the lower section 29 of planing fin 24. The length of the common base of the turning wedge is preferably less than one-fourth the length of its flotation unit but greater than one-fifth of such length.

Figure 5:
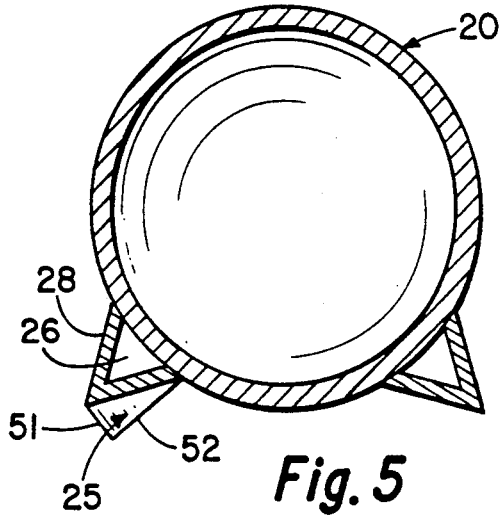
FIG. 5 is an enlarged sectional view of the starboard flotation unit of the pontoon boat taken along lines 5—5 of FIG. 1.
Figure 6:
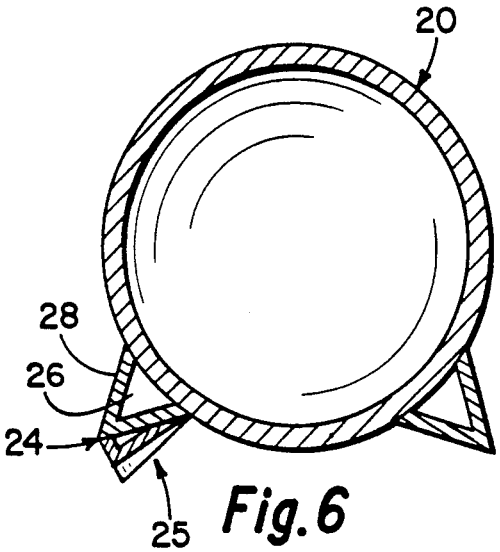
FIG. 6 is an enlarged sectional view of the starboard flotation unit of the pontoon boat taken along lines 6—6 of FIG. 1.
Figure 8:
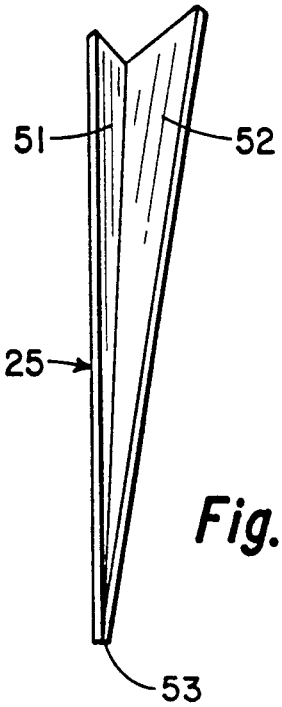
FIG. 8 is a top plan view of the turning wedge on the starboard flotation unit when viewed at an angle of sixty degrees from the vertical.
Figure 7:
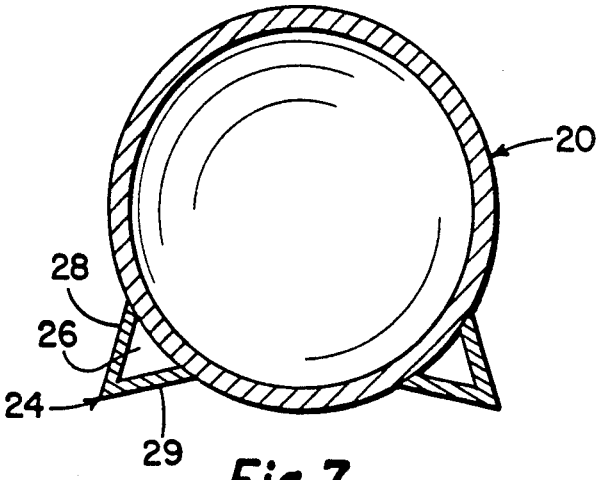
FIG. 7 is an enlarged sectional view of the starboard flotation unit of the pontoon boat taken along lines 7—7 of FIG. 1.

As best seen in FIG. 5, the hypotenuse of triangular shaped side 51 of the turning wedge 25 is secured, as by welding, to the fold line where lower planing section 29 joins upper planing section 28 and the hypotenuse of triangular shaped side 52 of the turning wedge 25 is similarly secured to the surface of the lower planing section 28. The point 53, where the hypotenuse of each side and the common base meet, is located on the noted fold line a short distance from the junction 27 between the nose cone and flotation unit. The end of the turning wedge 25 remote from point 53 is preferably open.

The function of the planing fins 24 in providing planing lift at various speeds will be described in connection with the diagramatic outlines of the starboard flotation unit shown in FIGS. 9 through 12 when the pontoon boat is at rest; when travelling at 10 miles per hour; when travelling at 25 miles per hour; and when travelling at 40 miles per hour, respectively.

Figure 9:
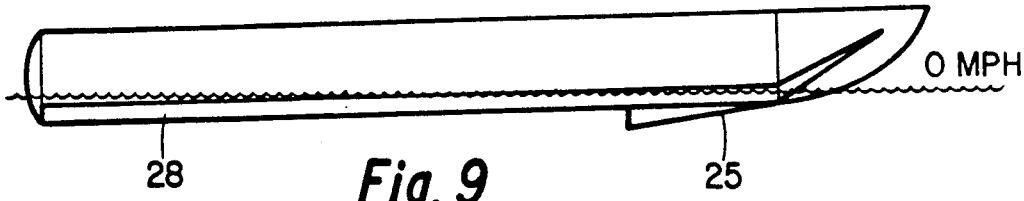
FIGS. 9 through 12 are diagramatic outlines of the starboard flotation unit of the pontoon boat of FIG. 1 showing the points at which the water line contacts the planing fins while travelling at the respective indicated speeds.

As seen in FIG. 9, the pontoon boat is so designed that when at rest, the stern sets lower in the water than the bow which is at a level such that the upper section 28 of the planing fins is completely submerged with the uppermost portion thereof meeting the water line at the point designated 60.

Figure 10:
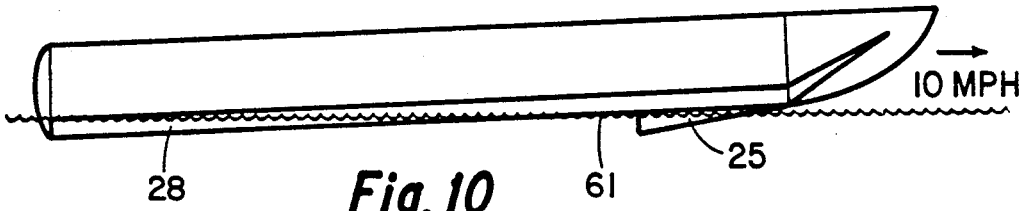

When the pontoon boat is travelling at 10 miles per hour, as illustrated in FIG. 10, the water striking the modified flotation unit, generates sufficient lift to raise the bow such that the modified flotation unit contacts the water line at point 61. The lower section 52 of turning wedge 25 is still submerged and while some drag is created, the passage of water thereunder generates additional lift which is greatest as the water line contacting the modified flotation unit moves from point 53 of the turning wedge to the stern end of such wedge.

Figure 11:
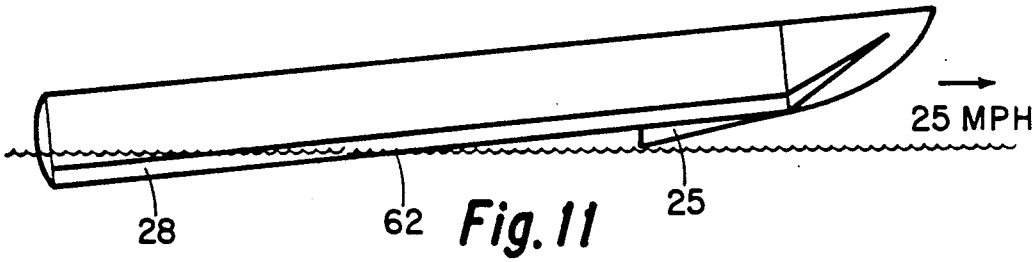
Figure 12:
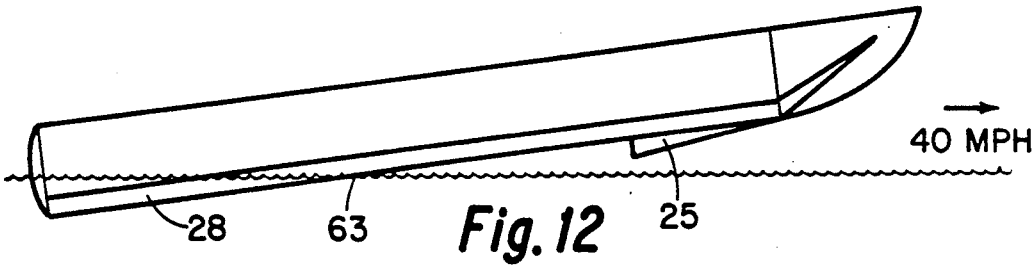

As seen in FIG. 11, when the pontoon boat attains a speed of 25 miles per hour, the water line contacts the surface of the modified flotation unit at point 62 which is approximately the middle of the flotation unit. At this time the turning wedge is completely out of the water and the pontoon boat is in a slow-speed planing mode. At a speed of 40 miles per hour, as seen in FIG. 12, the water line contact with the modified flotation unit has moved to point 63 and the pontoon boat is in its full-speed planing mode, with minimum flotation unit surface drag.

It is to be understood that the lift angle of the pontoon boat and the specific points at which the water line contacts the modified flotation unit are examples of a preferred embodiment of the invention and may vary with boat length, weight, motor power, and other considerations while still employing the inventive planing fins which permit pontoon boats with U-shaped or circular flotation units to plane at lower speeds than similar pontoon boats without the described planing fins.

As described in connection with FIGS. 9 through 12, the turning wedges on the outboard planing fin on each flotation unit supplement the lift generated by the planing fins, particularly at speeds between 10 and 25 miles per hour, thereby reducing the time for the boat to reach the planing mode. These turning wedges 25 individually function to reduce outward banking control problems as will now be described.

Figure 13:
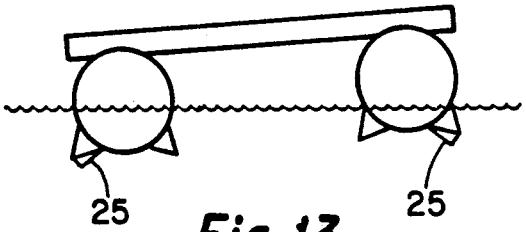
FIG. 13 is a diagramatic outline of the front elevation of the pontoon boat, taken along lines 5—5 of FIG. 1, showing the depths of the two flotation units when sharply turning at a planing speed in excess of 25 miles per hour.
Figure 14:
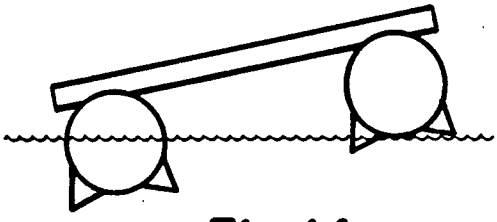
FIG. 14 is a diagramatic outline of the front elevation of the pontoon boat, taken along lines 5—5 of FIG. 1, showing the depths of the two flotation units when sharply turning at a planing speed in excess of 25 miles per hour with the turning wedges removed from the planing fins.

FIG. 13 is a diagramatic representation of the front view of a pontoon boat with the inventive turning wedges making a sharp turn to the right while travelling at planing speeds of 25 miles per hour and FIG. 14 is a diagramatic representation of such pontoon boat without the inventive turning wedges making the noted high speed turn.

As hereinbefore described, a pontoon boat banks outwardly when turning and the greater the speed at the time of turning, the greater the angle of banking. As seen in FIGS. 11 and 12, during straight-line planing speeds in excess of 25 miles per hour, the turning wedges 25 are both out of the water. However, when a sharp turn, to the right for example, is initiated at such speeds, the flotation unit 20 is forced downward by the noted outward banking forces and the entire length of the planing fins as well as the turning wedge are forced into the water.

Without the turning wedges, the planing fins would become completely submerged and the flotation unit would assume a relatively horizontal position, in which position there is little or no lift being generated by the planing fins which are also horizontal. The drag on the submerged flotation unit is great and tends to force the pontoon boat in a straight rather than curved direction. With little or no lift from the planing fins, the banking angle becomes extreme as illustrated in FIG. 14.

As best seen in FIG. 1, the pontoon boat is shown in a horizontal position with the planing fins correspondingly being in a horizontal position. However, the lower section 52 of the turning wedge is at a downward angle from the horizontal. Thus when the outboard flotation unit is forced downwardly on high speed turns and tend to assume a horizontal position as before described, the lower section of the turning wedge is at an angle to the movement of water and lift is generated. The size of the lower surface of the turning wedge is so selected that at speeds between 25 and 30 miles per hour, the lift is sufficient to prevent the flotation unit from assuming a horizontal position and thus the planing fins are effective to create lift. The lift from the planing fins together with the lift from the turning wedges sufficiently counteract the centrifugal force to maintain a substantial portion of the flotation unit 20 above the water and prevent extreme banking as seen in FIG. 14 when most of flotation unit 20 is submerged.

The beneficial effect of the turning wedges has been described in connection with planing fins attached to flotation units of U-shaped or circular cross section. It is to be noted that the inventive turning wedges could provide improved control of pontoon boats on turns if the wedges are attached directly to flotation units without planing fins as the wedges function to prevent the flotation units from assuming a horizontal position wherein little or no lift is generated. As long as the flotation units are directed upwardly when moving through the water, some lift is generated, which opposes the downward force from outward banking on turns.

While a preferred embodiment has been described in detail, it is to be understood that other embodiments and applications are possible without departing from the scope and spirit of the invention as set out in the appended claims.

What is claimed is:

1. A planing pontoon boat comprising in combination;

a plurality of elongated water-tight flotation units each having a bottom configuration of circular cross-section and each having a rigid exterior hull;

an elevated deck structure rigidly secured to said flotation units including means for positioning and maintaining said flotation units in parallel spaced-apart relation;

a plurality of elongated planing fins each having a rectangular shaped lifting surface on the underside thereof, and means for rigidly securing repective ones of said planing fins to the inboard and the outboard side of each flotation unit near the bottom portion thereof and below the water line, with said planing fins extending longitudinally of the flotation units and extending laterally and downwardly therefrom with the lifting surface of each planing fin in continuous contact with the water.

2. A planing pontoon boat as defined in claim 1, wherein said elongated planing fins are of a uniform V-shaped cross-sectional configuration.

3. A planing pontoon boat as defined in claim 1, wherein the said laterally extending planing fins are each of a uniform V-shaped cross-sectional configuration and each comprise first and second elongated sections connected to each other along a common longitudinal axis and angularly spaced apart, and wherein the said common axis of the planing fins of each flotation unit lie in a horizontal plane tangent to the circular bottom portion of such flotation unit.

4. A planing pontoon boat comprising in combination;

a plurality of elongated water-tight flotation units each having a bottom configuration of circular cross-section and each having a rigid exterior hull;

an elevated deck structure rigidly secured to said flotation units including means for positioning and maintaining said flotation units in parallel spaced-apart relation;

a plurality of elongated planing fins each having a rectangular shaped lifting surface on the underside therof;

means for rigidly securing repective ones of said planing fins to each flotation unit near the bottom portion thereof and below the water line, with said planing fins extending longitudinally of the flotation units and extending laterally therefrom;

turn-stablizing means; and means for rigidly securing said turn-stablizing means to the lifting surface of each planing fin with said turn-stablizing means extending longitudinally of said planing fin and laterally inclined downwardly and downwardly therefrom with the lifting surface of each planing fin in continuous contact with the water.

5. A planing pontoon boat as defined in claim 4, wherein said turn-stablizing means is downwardly inclined longitudinally and downwardly inclined laterally of said planing fins.

6. A planing pontoon boat as defined in claim 4, wherein said means for securing respective ones of said planing fins to said flotation units includes means for securing respective ones of said planing fins to the inboard side and to the outboard side of each flotation unit, and wherein said turn-stablizing means is secured to the planing fin secured to the outboard side of said flotation unit.

* * * * *